US005847632A

United States Patent [19]

Oshima

[11] Patent Number: 5,847,632

[45] Date of Patent: Dec. 8, 1998

[54] REED SWITCH

[75] Inventor: Toshihiro Oshima, Tokyo, Japan

[73] Assignee: Oki Electric Industry Co., Ltd., Tokyo, Japan

[21] Appl. No.: 890,988

[22] Filed: Jul. 10, 1997

[30] Foreign Application Priority Data

Oct. 25, 1996 [JP] Japan ..... 8-284048

[51] Int. Cl.[6] ..... H01H 71/20

[52] U.S. Cl. ..... 335/151; 335/154

[58] Field of Search ..... 335/57, 71.2, 151, 335/152–4, 156; 29/622

[56] References Cited

U.S. PATENT DOCUMENTS 4,769,622 9/1988 Leavitt ..... 335/154

FOREIGN PATENT DOCUMENTS 394393 3/1961 Switzerland ..... 335/154

513399 5/1976 U.S.S.R. ..... 335/151

*Primary Examiner*—Lincoln Donovan

*Attorney, Agent, or Firm*—Jones & Volentine, L.L.P.

[57] ABSTRACT

The reeds of a reed switch include convex portions embedded in a glass tube and extending into a cavity defined in the glass tube. The fulcrums about which the reeds are spring-operated are regulated by the positions of the convex portions, rather than by the interface position with the glass tube. As such, a reed switch having desired characteristics can be reliably fabricated regardless of manufacturing process variations.

16 Claims, 7 Drawing Sheets

REED SWITCH

BACKGROUND OF THE INVENTION

1. Field of the Invention

This invention relates to a reed switch, and particularly to configurations of reeds employed in the reed switch.

2. Description of the Related Art

A reed switch has been widely used in a shock sensor, an acceleration sensor, etc. A configuration of a conventional reed switch is shown in FIG. 10.

The reed switch 1 shown in FIG. 10 comprises a pair of reeds 10-1 and 10-2 and a glass tube 20. The reeds 10-1 and 10-2 have structures shown in FIG. 11 respectively. As shown in FIG. 11, the reed 10 is shaped in the form of a rectangular plate. As a material used for the reed 10, a magnetic material such as a permalloy is used. The shape of the reed 10 is obtained by extending the magnetic material into a thin plate of a predetermined thickness and thereafter stamping it to a required shape using a die or mold.

The reeds 10-1 and 10-2 formed in this way are fixed so that one ends thereof are located within the glass tube 20 and the other ends thereof are located out of the glass tube 20. FIG. 12 is a cross-sectional view taken along line A–A' of FIG. 10.

Referring to FIG. 12, a hollow portion or cavity 24 is defined in the glass tube 20. The cavity 24 is filled with a nitrogen gas, for example. The reeds 10-1 and 10-2 are respectively sealed with and fixed to sealing portions 22-1 and 22-2 of the glass tube 20. A leading end 12-1 of the reed 10-1 placed within the cavity 24 and a leading end 12-2 of the reed 10-2 placed therewithin are opposed to each other with a predetermined interval $\alpha$ left therebetween. The overlapping length of each of the opposed leading ends 12-1 and 122 is defined as $\beta$. The reeds 10-1 and 10-2 are provided so that the distances between the sealing portion 22-1 and the leading end 12-1 of the reed 10-1 and between the sealing portion 22-2 and the leading end 12-2 of the reed 10-2 are defined as $L_1$ and $L_2$ respectively. At this time, support points or fulcrums about which the reeds 10-1 and 10-2 are spring-operated, are designated at numerals 30-1 and 30-2 respectively. Namely, the fulcrums are determined at positions where the reeds 10-1 and 10-2 are sealed with the glass tube 20. Spring characteristics of the reeds 10-1 and 10-2 are determined according to the thicknesses and widths of the reeds, the distances $L_1$ and $L_2$, the Young's moduli of the materials for the reeds, etc. The characteristic of the reed switch is determined depending on the spring characteristics, the interval $\alpha$, the opposing area ($\alpha \times \beta$), etc.

Further, one example of another configuration of the reed 10 is shown in FIG. 13. The reed 50 has a sealing portion 52 sealed with and fixed by or to a glass tube, which extends in cylindrical form. A portion located within a hollow portion or cavity defined in the glass tube consists of an intermediate portion 54 which extends in plate form, and a leading end 56 which extends in plate form and is opposed to the other reed. The thickness of the intermediate portion 54 is thinner than that of the leading end 56. In the reed 50 constructed as described above, the support point or fulcrum about which the reed 50 is spring-operated, is given as a fulcrum 70 regardless of sealing positions of the glass tube. The reed 50 is obtained by press-molding the intermediate portion 54 and the leading end 56 each composed of a wire-line magnetic material to their corresponding required thicknesses.

However, in the reed switch having the configuration shown in FIG. 10 through 12, the fulcrum about which the reed 10 is spring-operated, is determined depending on the position where the reed 10 is sealed with the glass tube 20. When the reed 10 is sealed with and fixed to the glass tube 20, the glass tube 20 is heated to 1000° C. or higher. Therefore, the position at which the reed 10 is fixed by the glass tube 20 and the shape of the glass tube at its fixed portion varies due to the viscosity of the melted glass tube, heat divergent conditions of the reed 10 and the glass tube 20, etc. It is therefore difficult to set each of the distances L1 and L2 respectively defined between the sealing portions and the leading ends of the reeds to a predetermined length. As a result, a problem arises in that the characteristic of the reed switch varies for each fabricated reed switch.

In the reed switch using the reed 50 shown in FIG. 13, the fulcrum about which the reed 50 is spring-operated, is given as the fulcrum 70 regardless of the sealing positions of the glass tube. However, when the reed 50 is sealed with and fixed to the glass tube, the area of the sealing portion 52 that makes contact with the glass tube, is small because the sealing portion 52 is cylindrical. Thus, a problem arises in that a tensile strength against tension applied to the reed 50 from the outside becomes weak. Since the shape of the sealing portion 52 brought into contact with the glass tube is cylindrical, the strength of the reed 50 against torsion becomes weak. Namely, there may be cases in which the reed 50 is processed in various ways. For example, a process for bending the sealing portion or terminal portion 52 of the reed 50 in L form is known. Upon such processing, a portion of the terminal portion 52 in the neighborhood of the glass tube is held by unillustrated holding means. However, since the terminal portion 52 is cylindrical, the axial rotation of the reed 50 cannot be reliably held. As a result, a rotating force is applied in the axis direction of the reed 50 with the L-shaped bending of the terminal portion 52 of the reed 50. Therefore, the reed 50 is rotated to thereby vary an interval $\alpha$ between the leading end 56 of the reed 50 and a leading end of a reed opposing the reed 50. Thus, a problem arises in that the characteristic of the reed switch varies. Since a wire-like magnetic material is press-molded as distinct from one obtained by stamping a plate-shaped magnetic material to shape by a die as shown in FIGS. 10 through 12, the thicknesses and widths of the intermediate portion 54 and the leading end 56 of the reed 50 vary due to the pressing referred to above. As a result, a problem arises in that the characteristic of the reed switch varies for each fabricated reed switch.

With the foregoing problems in view, it is therefore an object of the present invention to provide a reed switch capable of stably providing a free-variation characteristic thereof each time it is manufactured.

Another object of the present invention is to provide a reed switch resistant to torsion or tension applied to reeds.

A further object of the present invention is to provide a reed switch capable of changing stiffness of reeds according to a required characteristic without changes in the thickness and width of each reed.

SUMMARY OF THE INVENTION

According to one aspect of the present invention, for achieving the above objects, there is provided a reed switch comprising:

a glass tube having a cavity defined therein; and first and second reeds respectively having one ends opposed to each other within the cavity at predetermined intervals and the other ends fixed to the glass tube so as to extend to the outside of the glass tube;

at least one of said first and second reeds having convex portions embedded within the glass tube and extending into the cavity.

Typical ones of various inventions of the present application have been shown in brief. However, the various inventions of the present application and specific configurations of these inventions will be understood from the following description.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DETAILED DESCRIPTION OF THE PREFERRED EMBODIMENTS

Preferred embodiments of the present invention will hereinafter be described in detail with reference to the accompanying drawings.

Figure 1:
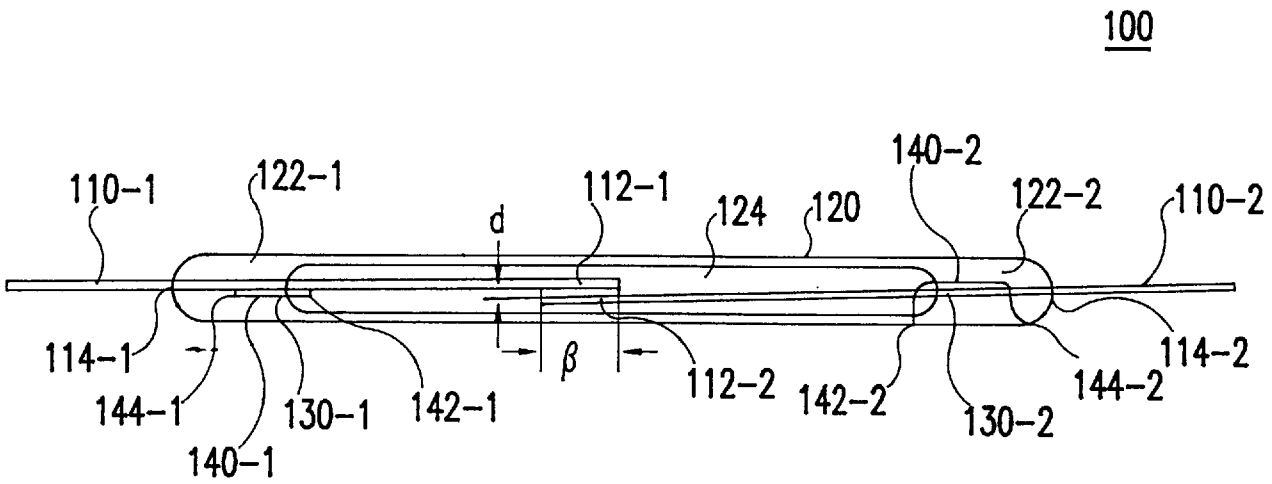
FIG. 1 is a schematic view of a reed switch showing a first embodiment of the present invention.
Figure 10:
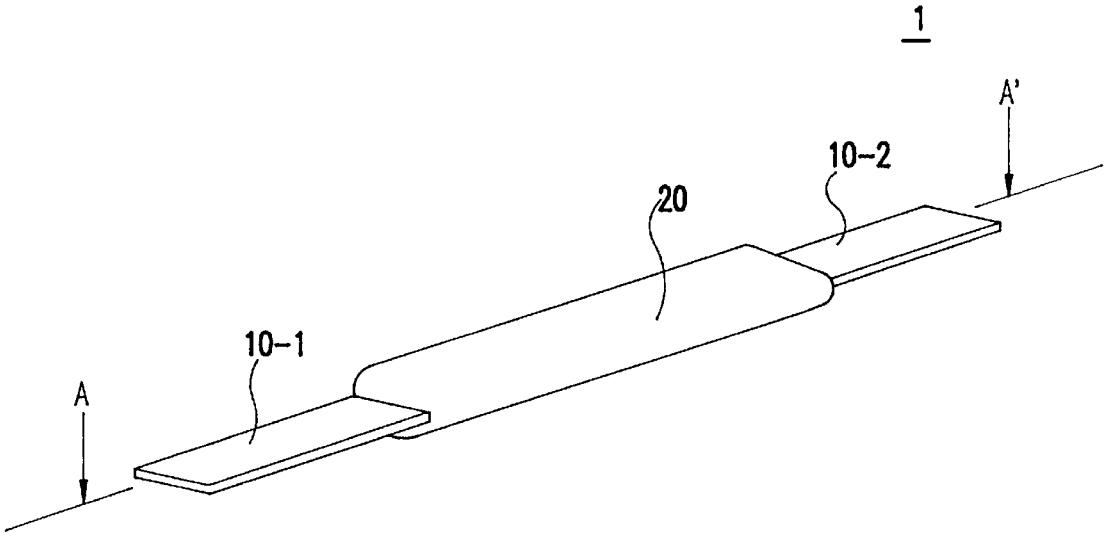
FIG.10 PRIOR ART
FIG. 10 is a perspective view showing a conventional reed switch.
Figure 11:
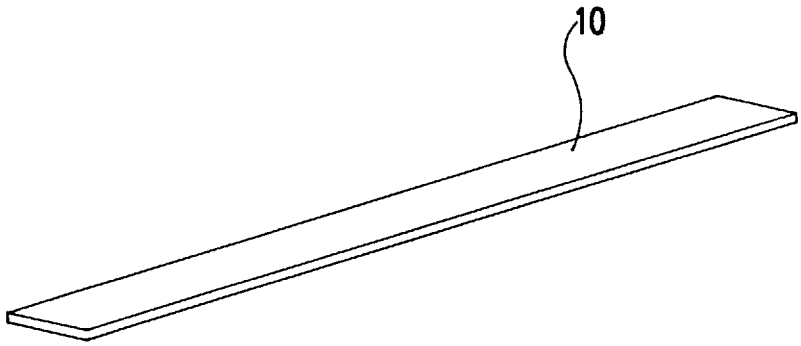
FIG.11 PRIOR ART
FIG. 11 is a perspective view illustrating a reed shown in FIG. 10.
Figure 12:
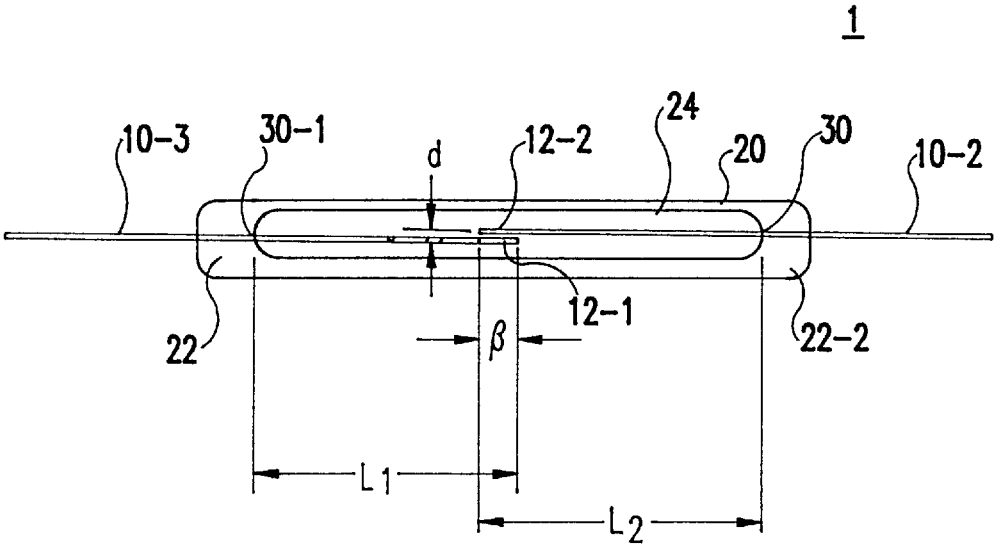
FIG.12 PRIOR ART
FIG. 12 is a cross-sectional view taken along line A–A' of FIG. 10.
Figure 13:
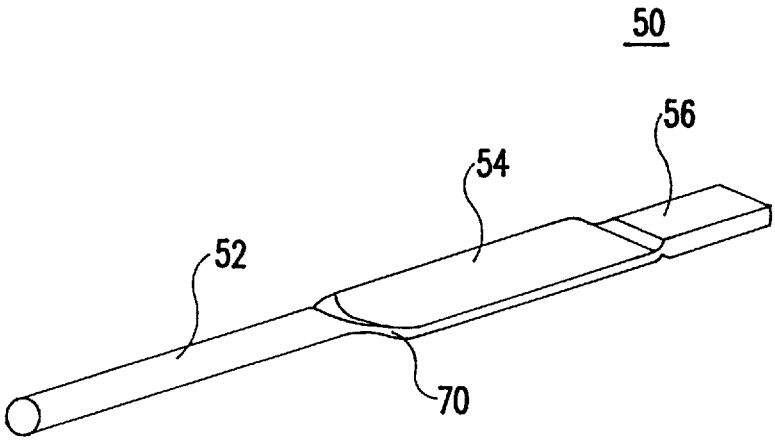
FIG. 13 PRIOR ART
FIG. 13 is a perspective view showing another configuration of a reed of a conventional reed switch.

FIG. 1 is a cross-sectional view showing a configuration of a reed switch illustrating a first embodiment of the present invention. The reed switch of the present invention is identical in outer appearance to that shown in FIG. 10. A cross-sectional view of the reed switch corresponds to a cross-sectional view taken along line A–A' of FIG. 1.

Figure 2:
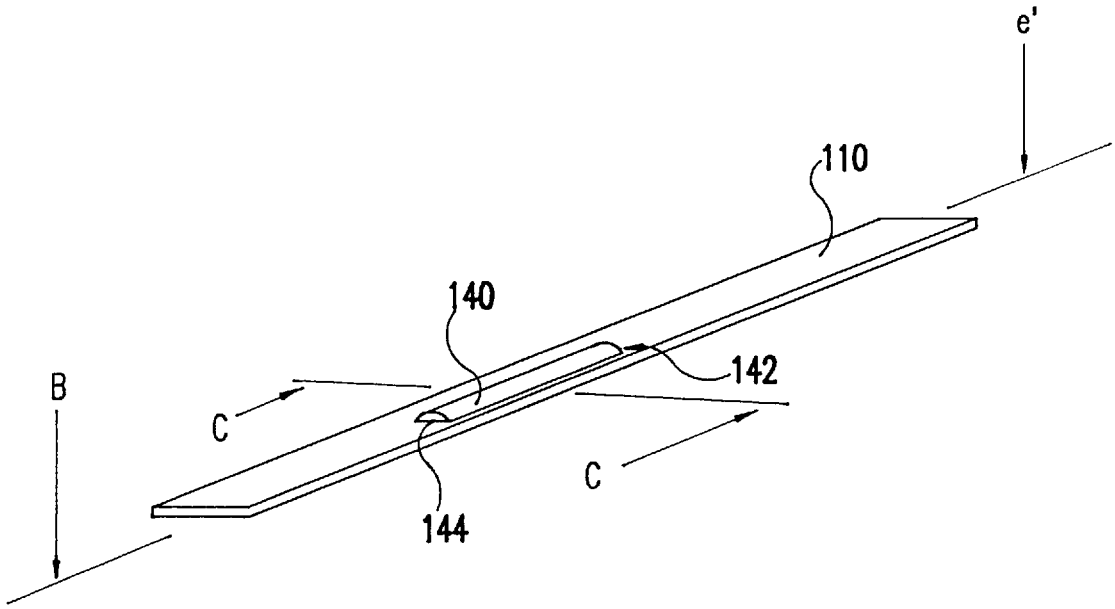
FIG. 2 is a perspective view of a reed shown in FIG. 1.
Figure 3:
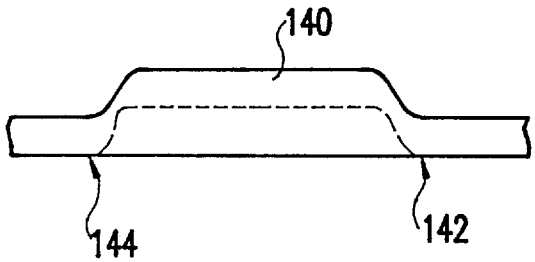
FIG. 3 is a cross-sectional view taken along line B–B' of FIG. 2.
Figure 4:
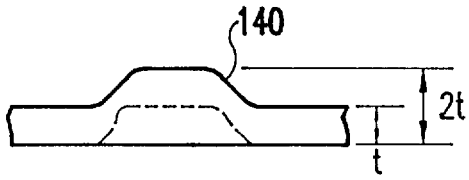
FIG. 4 is a cross-sectional view taken along line C–C' of FIG. 2.

Referring to FIG. 1, the reed switch 100 comprises a pair of reeds 110-1 and 110-2 and a glass tube 120. A hollow portion or cavity 124 is defined in the glass tube 120. The hollow portion 124 is filled with a nitrogen gas. Each of the reeds 110-1 and 110-2 has a structure shown in FIG. 2. As shown in FIG. 2, the reed 110 is shaped in the form of a rectangular plate. As a material used for the reed 110, a magnetic material such as a permalloy is used. The shape of the reed 110 is obtained by extending the magnetic material into a thin plate of predetermined thickness and thereafter stamping it to a required shape using a mold or die. A convex portion 140 is provided at the reed 110. The convex portion 140 is formed by providing a die frame or pins or the like within a part of a stamping die or mold so as to correspond to the convex portion upon forming the plate-shaped magnetic material by stamping in conjunction with the formation of the reed by stamping. A cross-section taken along line B–B' of FIG. 2 and a cross-section taken along line C–C' of FIG. 2 is shown in FIGS. 3 and 4 respectively. The height of the convex portion 140 will be defined as 2t corresponding to twice the thickness t of the reed. As shown in FIG. 1, the reeds 110-1 and 110-2 formed in this way are respectively sealed with and fixed to sealing portions 122-1 and 122-2 of the glass tube 120. At this time, the convex portions 140-1 and 140-2 are configured so that their parts are covered with the sealing portions 122-1 and 122-2 and their remaining parts extend to the hollow portion 124. A leading end 112-1 of the reed 110-1 placed within the hollow portion 124 and a leading portion 112-2 of the reed 110-2 placed therewithin are opposed to each other with a predetermined interval $\alpha$ left therebetween. The length of each of the opposed leading ends 112-1 and 112-2 is defined as $\beta$. The convex portions 140-1 and 140-2 are located so as to protrude in the directions opposite to the other reeds.

Fulcrums about which the reeds 110-1 and 110-2 of the reed switch 100 constructed in the above-described manner are spring-activated, correspond to leading ends 142-1 and 142-2 of the convex portions 140-1 and 140-2, which respectively protrude into the hollow portion 124. Thus, the fulcrums about which the reeds 110-1 and 110-2 are spring-operated, are given as the support points 142-1 and 142-2 regardless of the sealed positions of the glass tube.

A method of manufacturing the reed switch 100 will now be described in detail.

The magnetic material such as the permalloy or the like is first press-molded to form a plate of a predetermined thickness. Thereafter, it is stamped by pressing using a die to form used for a reed having a required shape. Since, at this time, the die frame and the pins or the like for shaping the convex portion has been formed in the die as described above, the convex portion 140 is provided at the reed 110 formed by stamping. The so-formed reeds 110-1 and 110-2 are inserted into a pre-sealing cylindrical glass tube 120 having a cavity or hollow portion defined therein. In the glass tube 120, the reeds 110-1 and 110-2 are maintained at a length $\beta$ and an interval $\alpha$ at which the leading ends thereof are opposed to each other. The reeds 110-1 and 110-2 are held by unillustrated clamp means. In this condition, the hollow portion defined in the glass tube 120 is filled with an inert gas such as a nitrogen gas. Under this condition, the portions of the reeds, which have been inserted into the glass tube 120, are heated and made molten by an infrared lamp so that the reeds 110-1 and 110-2 are sealed with and fixed to the glass tube 120. The positions of the sealed and fixed reeds 110-1 and 110-2 are defined as those at which glass in glass tube 120 is melted and not brought into contact with the fulcrums 142-1 and 142-2. For example, positions 130-1 and 130-2 extending in the reed sealing direction (convex-portion forming direction), which are spaced about 1 mm from one ends 142-1 and 142-2 used as the fulcrums, of the convex portions 140-1 and 140-2, are defined as positions where the glass tube 120 make contact with the reeds 110-1 and 110-2. Portions of the reeds 110-1 and 110-2, which extend to the outside from the glass tube 120, are located at positions where other ends 144-1 and 144-2 of the convex portions 140-1 and 140-2 are sufficiently covered with glass. For example, positions 114-1 and 114-2 extending in the directions in which the reeds 110-1 and 110-2 protrude to the outside spaced about 2mm from the other ends 144-1 and 144-2, are defined as positions where the glass tube 120 is brought into contact with the reeds 110-1 and 110-2, respectively.

The operation of the reed switch 100 constructed in the above-described manner will now be described. When no magnetic field is applied to the reed switch 100 from the outside thereof, the leading ends 112-1 and 112-2 of the reeds 110-1 and 110-2 are spaced away from each other with the predetermined interval $\alpha$ left therebetween. Accordingly, the reeds 110-1 and 110-2 are in an electrically non-conducting state. A magnetic field is now applied to the reed switch 100 from the outside of the reed switch 100. For example, the magnetic field is applied to the reed switch 100 in a state in which an N pole of a permanent magnet and an S pole thereof have approached the leading end 112-1 side of the reed 110-1 and the leading end 112-2 side of the reed 110-2, respectively. Owing to the magnetic field, the leading end 112-1 of the reed 110-1 takes the S pole and the leading end 112-1 thereof bears the N pole. Thus, the leading ends 112-1 and 112-2 of the reeds 110-1 and 110-2 are opposed to each other under the action of a magnetic attraction force with opposite areas formed by the opposite lengths $\beta$ and plate widths of the reeds. As a result, the leading ends 112-1 and 112-2 are brought into contact with each other by spring characteristics of the reeds. At this time, the fulcrums about which the leading ends 112-1 and 112-2 are spring-activated, are given as the leading ends 142-1 and 142-2 of the convex portions 140-1 and 140-2. Thus, each of the reeds 110-1 and 110-2 is electrically brought into conduction. Thereafter, when the magnetic field is eliminated from the reed switch 100, each of the reeds 1101 and 110-2 is restored to a non-contact state (electrically non-conducting state).

Figure 5:
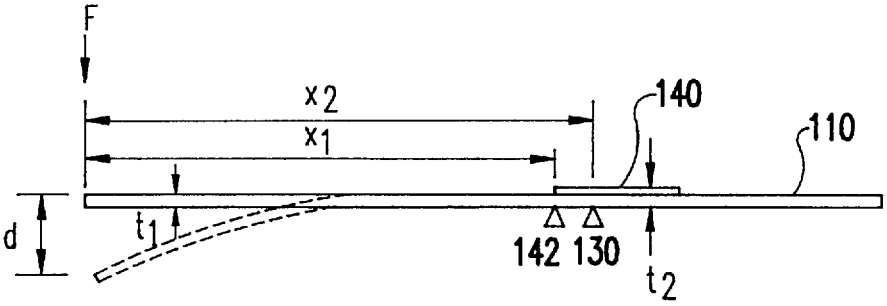
FIG. 5 is a view for explaining the operation of a convex portion of the reed shown in FIG. 1.

The reason why the reeds 110-1 and 110-2 are provided with the convex portions respectively, will now be described in detail. FIG. 5 is a view for describing the operation of the convex portion of each reed.

When the reed 110-1 repeatedly make contact and non-contact with the reed 110-2 due to the repetition of the application of the magnetic field to and the elimination of the magnetic field from the reed switch 100, the strength of the portion where the reed 110-1 is brought into contact with the reed 110-2, needs to have a value falling within a predetermined range regardless of conditions for using the reed switch 100. The value of its strength is determined according to the spring characteristics of the reeds and the interval $\alpha$ between the contact points (the leading ends of the reeds) of the reeds. Variations in the spring properties and the interval $\alpha$ become greatly associated with the characteristic of the reed switch. The spring characteristics are derived from the thicknesses, widths of the reeds and the lengths from the leading ends of the reeds to the fulcrums. The reeds of the reed switch 100 of the present invention are formed by stamping the plate-shaped magnetic material formed to the predetermined thickness in advance by the die having the predetermined shape. Therefore, the thickness and width of each fabricated reed do not vary.

The distance between the leading end of each reed and its corresponding fulcrum will next be described with reference to FIG. 5. Assuming that the thickness of the reed 110 is defined as t, for example, the height of the convex portion 140 formed on the reed 110 is set to about 2t corresponding to twice the thickness of the reed 110. Namely, the thickness of a portion at which the convex portion 140 is formed, is apparently thicker than that of the reed 110. In FIG. 5, a point indicative of the boundary between the thickness t and the thickness 2t is a portion designated at numeral 142. A point indicative of the boundary between portions sealed and unsealed with the glass tube is a portion designated at numeral 130. Namely, the boundary point 142 is a fulcrum of the reed 110, which corresponds to each of the leading ends 142-1 and 142-2 shown in FIG. 1, whereas the boundary point 130 corresponds to each of the positions 130-1 and 130-2 shown in FIG. 1. Further, the distance from the boundary point 142 to the leading end of the reed is defined as $X_1$ and the distance from the boundary point 130 to the leading end of the reed is defined as $X_2$. In the present embodiment, the distance X1 is set to about 10 mm and the distance $X_2$ is set to about 11 mm.

When a magnetic field is applied to the reed switch 100, a magnetic attraction force F is produced at the leading end of the reed 110. The reed 110 is bent by the magnetic attraction force F. A dotted line in FIG. 5 indicates the reed bent by the magnetic attraction force F. Now consider a displacement of the reed 110 by this bending as d. At this time, the reed 110 can be considered as a plate spring whose thickness and length are defined as t and $X_1$ respectively, and a support spring whose thickness and length are defined as 2t and $(X_2-X_1)$ respectively and whose one end is fixed and supported, using the boundary point 130 as the fulcrum. Here, the thickness of the support spring is represented as 2t and is twice the thickness t of the plate spring. Thus, the support spring has greater rigidity. Further, the length of the support spring is given as $(X_2-X_1)$ and reaches about 1 mm. Accordingly, the length of the support spring becomes shorter than the length $X_1$ (about 10mm) of the plate spring.

Let's now express the displacement d using an equation.

The displacement d can be given by the following equation:

$$\begin{aligned} d &= W/S \qquad (1) \\ &= W/E[X_1^3/3I_1 + (X_2 - X_1)^3/3I_1 + \\ &\quad 1/I_2\{X_1^2(X_2 - X_1) + X_1(X_2 - X_1)^2\}] \end{aligned}$$

In the equation (1), S indicates stiffness of each reed, W indicates a load applied to the leading end of the reed, E indicates a Young's modulus of the reed, $I_1$ indicates a moment of inertia of area of the plate spring, and $I_2$ indicates a moment of inertia of area of the support spring. The moments $I_1$ and $I_2$ can be expressed by the following equations:

$$I_1 = D_1 T_1^3/12 \qquad (2)$$

$$I_2 = D_2 T_2^3/12 \qquad (3)$$

In the equation (2), $D_1$ indicates the width of the plate spring, and $T_1$ indicates the thickness of the plate spring. In the equation (3), $D_2$ indicates the width of the support plate, and T2 indicates the thickness of the support plate.

Now consider where the following relationship is established between the plate spring and the support spring:

$$T_2 = aT_1 \qquad (4)$$

$$X_2 - X_1 = 1/b \cdot X_1 \qquad (5)$$

$$D_2 = D_1 \qquad (6)$$

In the equation (4), a is a value indicating the ratio between the thickness $T_2$ of the support spring and the thickness $T_1$ of the plate spring, and 1/b is a value indicating the ratio between the length $(X_2-X_1)$ of the support spring and the length $X_1$ of the plate spring corresponds.

The following relationship is established from the equations (4) and (6) on the basis of the equations (2) and (3):

$$I_2=a^3I_1 \tag{7}$$

The equation (1) is expressed from the equations (5) and (7) as follows:

$$\begin{aligned} d &= W/E\{X_1^3/3I_1+X_1^3/a^3b^3I_1+1/a^3I_1(1/b\cdot X_1^3+ \\ &\quad 1/b^2\cdot X_1^3)\} \\ &= 1/3\cdot WX_1^3/I_1E\{(a^3b^3+3b^2+3b+3)/a^3b^3\} \end{aligned} \tag{8}$$

Similarly, the reed is constructed of the plate spring alone. Namely, when $(X_2-X_1)=0$, a displacement $d_0$ of the reed whose length is $X_1$, is given from the equation (1) as follows:

$$d_0=1/3\cdot WX_1^3/I_1E \tag{9}$$

where, in the equation (9), the width of the plate spring is defined as $D_1$ and the thickness thereof is defined as $T_1$.

The following relationship is given from the equations (8) and (9):

$$d/d_o=(a^3b^3+3b^2+3b+3)/a^3b^3=k \tag{10}$$

Namely, it is understood from the above equation (10) that the displacement d of the reed constructed of the plate spring and the support spring having the relationship given by the equations (4) through (6) coincides with k times the displacement $d_0$ of the reed composed of the plate spring alone.

Since a=2 and b=10 in the above-described embodiment, k=about 1.042.

An allowable range of a displacement dx of the reed is normally $dx\pm(dx/2)$. Therefore, if the displacement is given as $d_0$, its allowable range becomes $d_0\pm(d_0/2)$. Thus, the magnification, of each of the maximum and minimum values falling within the allowable range, with respect to the reference ranges from 0.5 to 1.5 times.

Thus, if a=2 and b=10 as in the present embodiment, then the displacement can be regarded as being approximately the displacement of the reed constructed of the plate spring alone. The present embodiment shows the case in which the displacement can be considered approximately to that of the reed composed of the plate spring alone with a=0 and b=10. However, the present invention is not necessarily limited to or by these values.

Since the magnification relative to the reference falls within the allowable range as described above if ranging from 0.5 to 1.5 times, it is understood that k may fall between 0.5 and 1.5. Here, it is understood from the equation (10) that k in the equation (10) becomes a numeric value exceeding at least 1. Thus, the equation (10) is considered as follows:

$$\begin{aligned} &1.5\geqq(a^3b^3+3b^2+3b+3)/a^3b^3>1 \\ &1.5\geqq1+3(b^2+b+1)/a^3b^3>1 \end{aligned} \tag{11}$$

Namely, a and b may satisfy the equation (11). However, if $3(b^2+b+1)/a^3b^3$ is smaller, then a and b can be considered more approximately as the displacement of the reed composed of the plate spring alone. If an approximately considerable range is regarded as 1+f (where $0\leqq f\leqq0.5$), for example, then a and b may be set so as to satisfy $f\geqq3(b^2+b+1)/a^3b^3$.

Accordingly, the reed 110 can be considered as the plate spring having the thickness t and the length $X_1$ with the fulcrum as 142. The displacement d or the like can be also calculated approximately in consideration of this point of view. Since the boundary point 130 is not necessarily kept constant due to characteristics of the molten glass upon sealing and fixing, the distance $X_2$ varies. Since, however, the distance $X_2$ does not contribute the spring characteristics such as the displacement d, etc. of the reed 110 as described above in detail, no problem arises. Although the example in which the thickness of the support spring is set to twice the thickness of the plate spring and the length of the support spring is set to one-tenth the length of the plate spring, has been described above, it is needless to say that the thickness and length of the support spring are not necessarily limited to these.

Thus, even if the fulcrum 130 is shifted in position, the influence of the spring characteristics of the reed, which influences the property of the reed switch, can be reduced.

Tensile strength applied to the portions, extending to the outside of the glass tube 120, of the reeds 110-1 and 110-2 of the reed switch 100 contributes to the strength of the glass tube 120 and the strength of the sealing portions 122-1 and 122-2 to which the glass tube 120 and the reeds 110-1 and 110-2 are fixed by sealing. In the reed switch 100 of the present invention, the portions of the convex portions 140-1 and 140-2 are covered with the sealing portions 122-1 and 122-2 as shown in FIG. 1. Therefore, the tensile strength applied to the reeds 110-1 and 110-2 from the outside can be physically accepted by differences in level or steplike offsets formed by the convex portions 140-1 and 140-2, and the glass tube. It is thus possible to increase the strength resistant to or against the tension applied from the outside.

Figure 6:
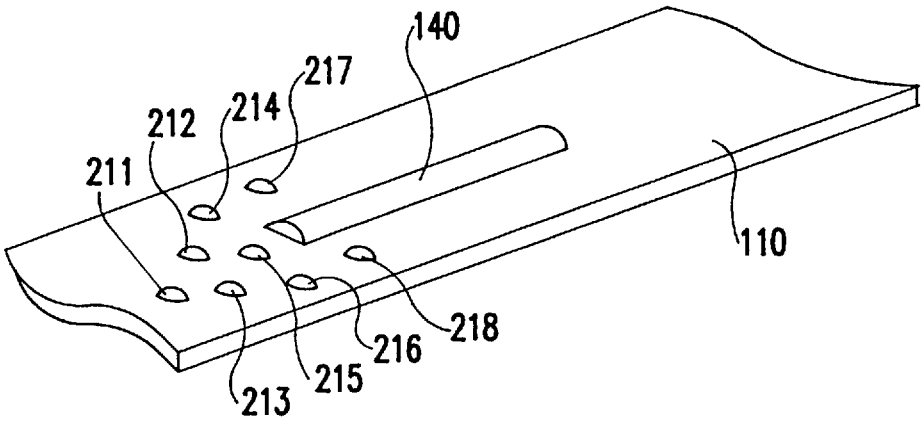
FIG. 6 is a partly enlarged view of a reed shown as a second embodiment of the present invention.
Figure 7:
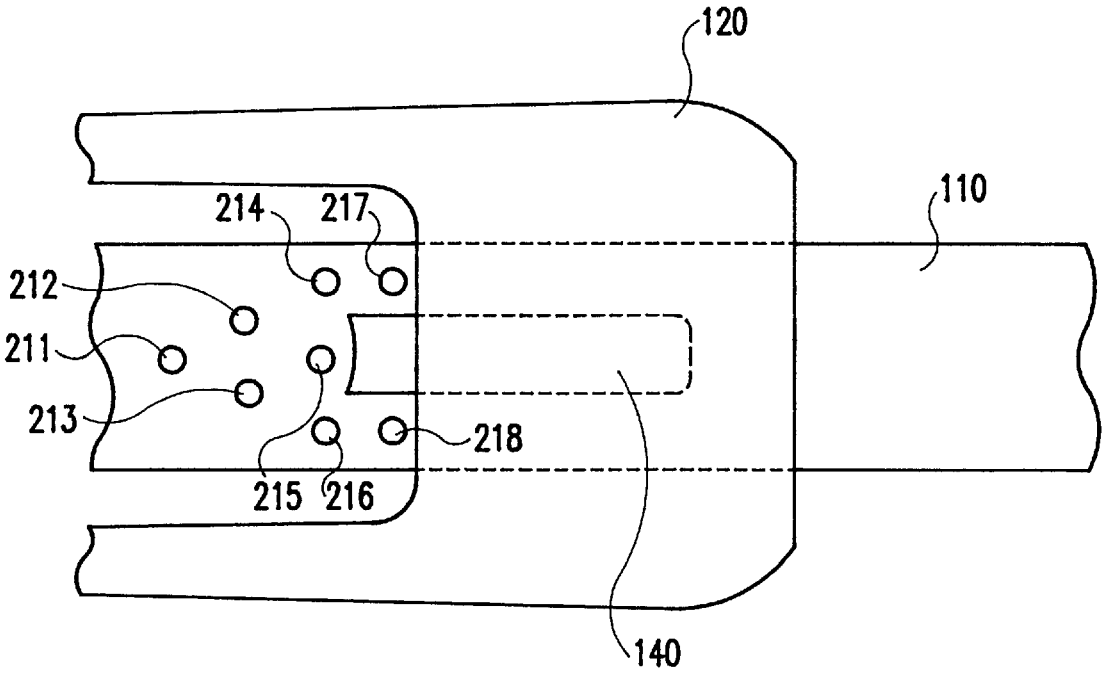
FIG. 7 is a top view for describing a state in which the reed shown in FIG. 6 has been sealed with and fixed to a glass tube.

A second embodiment of the present invention will next be described with reference to FIGS. 6 and 7. FIG. 6 is a partly enlarged view of a reed showing the second embodiment of the present invention. FIG. 7 is a top view showing a state in which the reed shown in FIG. 6 has been sealed.

Referring to FIG. 6, a reed 110 has a plurality of convex portions or protrusions 211 through 218 formed in the neighborhood of a convex portion 140. The direction in which the protrusions 211 through 218 project, is identical to that in which the convex portion 140 protrudes. As shown in FIG. 7, the protrusions 211 through 218 are located at positions unsealed with a glass tube 120 and formed so as to be positioned within a cavity defined in the glass tube 120. Each of the protrusions 211 through 218 is smaller than the convex portion 140 and shaped in the form of a semicircle. Owing to the provision of the plurality of protrusions 211 through 218 in this way, the spring characteristic of the reed can be enhanced.

In a manner similar to the formation of the convex portion 140, the protrusions 211 through 218 are formed by placing pins in positions corresponding to the protrusions 211 through 218 within a die for the reed 110. Referring also to FIG. 6, the number of the protrusions 211 through 218 is seven. However, the number of the protrusions is not necessarily limited to this. For example, the number of the protrusions may be a number below or above seven. If the pins placed in the die so as to correspond to the protrusions 211 through 218 are provided so as to be insertable into and extractable from the die at this time, then an arbitrary number of protrusions can be formed.

Figure 8:
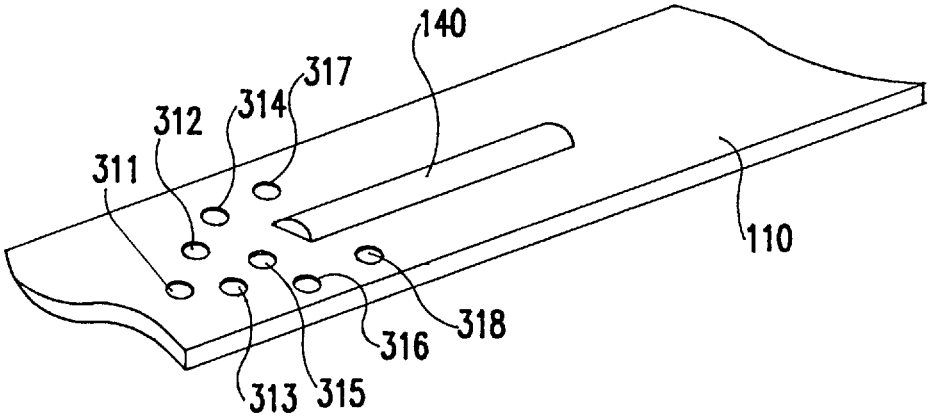
FIG. 8 is a partly enlarged view of a reed shown as a third embodiment of the present invention.
Figure 9:
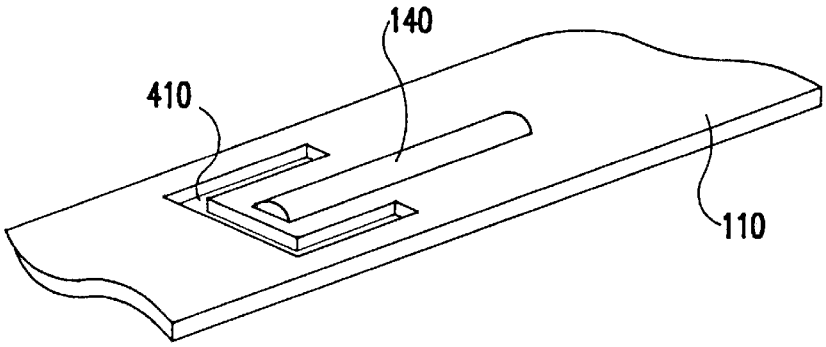
FIG. 9 is a partly enlarged view of a reed shown as a fourth embodiment of the present invention.

A third embodiment of the present invention is shown in FIG. 8. A fourth embodiment of the present invention is illustrated in FIG. 9. FIG. 8 is a partly enlarged view of a reed showing the third embodiment of the present invention. FIG. 9 is a partly enlarged view of a reed illustrating the fourth embodiment of the present invention.

Referring to FIG. 8, a reed 110 has a plurality of holes 311 through 318 defined in the neighborhood of a convex portion 140. In a manner similar to the protrusions 211 through 218 employed in the second embodiment, the holes 311 through 318 are placed in their corresponding positions unsealed with a glass tube 120 and formed so as to be placed within a cavity defined in the glass tube 120. Each of the holes 311 through 318 is smaller than the convex portion 140 in size. Owing to the provision of the plurality of holes 311 through 318 in the above-described manner, the spring property of the reed 110 can be reduced contrary to the second embodiment.

Similarly, a reed 110 has an inverted U-shaped cut-away portion 410 defined in the neighborhood of a convex portion 140 in FIG. 9. In a manner similar to the protrusions 211 through 218 employed in the second embodiment, the cut-away portion 410 is placed in its corresponding position unsealed with a glass tube 120 and formed so as be placed within a cavity defined in the glass tube 120. Owing to the provision of the cut-away portion 410 in the above-described manner, the spring property of the reed 110 can be weakened.

The plurality of holes 311 through 318 and the cut-away portion 410 are formed by placing punching pins and a punching core within dies for the reeds at positions corresponding to the holes 311 through 318 and the cut-away portion 410. Referring to FIG. 8, the number of the holes 311 through 318 is seven but not limited to this. For example, the number of the holes may be a number smaller or greater than seven. If the punching pins corresponding to the holes 311 through 318 placed within the die are provided so as to be insertable into and extractable from the die at this time, then an arbitrary number of holes can be defined. Similarly, the cut-away portion 410 is shaped in the form of an inverted U-shape as shown in FIG. 9 but not limited to this. For example, the cut-away portion 410 may be U-shaped or V-shaped. If the punching core corresponding to the cut-away portion 410 placed within the is provided so as to be interchangeable, then arbitrary-shaped cut-away portions can be defined.

Stiffness of the reed switches can be freely changed by constructing the reed switches as in the second through fourth embodiments. Assuming that a load placed on the leading end of the reed is defined as W and the displacement of the leading end of the reed at the time that the load W is imposed thereon, is defined as d, the stiffness is expressed as W/d. The stiffness is an important element in determining the characteristic of the reed switch. The strength of the reed against the load W can be changed by providing the protrusions 211 through 218, holes 311 through 318 and cut-away portion 410 as in the second through fourth embodiments. Owing to the provision of the protrusions 211 through 218, for example, the apparent thickness of the reed can be made thicker and the displacement d relative to the load W can be reduced. Further, owing to the provision of the holes 311 through 318 or the cut-away portion 410, the apparent thickness of the reed can be made thinner and the displacement d relative to the load W can be increased. It is thus possible to adjust the stiffness as necessary.

The magnetoresistance of a magnetic circuit or path formed when a magnetic field is applied to the reed switch, can be changed by forming the protrusions 211 through 218, the holes 311 through 318 and the cut-away portion 410 in the magnetic material like the reed. Thus, a working or work-sensitive characteristic and an open characteristic can be adjusted. The term working characteristic is one which contributes to the strength of a magnetic field at the time that the leading ends of the two reeds of the reed switch contact each other, i.e., the reeds electrically conduct each other. In this case, the magnetic field strength is expressed as a work-sensitive or working value. The term open characteristic is one which contributes to the strength of a magnetic filed at the time that the leading ends of the two reeds of the reed switch are spaced away from each other, i.e., the reeds do not electrically conduct from one to the other. In this case, the magnetic field strength is expressed as an open value. Since the working value differs from the open value in the case of one reed switch, the reed switch is often employed for various devices using the difference between the working value and the open value. In the present invention, a plurality of types of reed switches in which the differences between the working values and the open values differ from one another, can be manufactured without a change in the manufacturing process by simply devising the structure of the die for the reed.

The structure of the reed switch according to the present invention has been described above in detail inclusive of the method of manufacturing the reed switch. However, the present invention is not necessarily limited to the above-described structure. Even if the number of reeds is three or other numbers, for example, although the reed switch with the two reeds has been used in the illustrated embodiment, the reed structure of the present invention is applicable.

The present invention has been described with the reed switch regarded as a single one. However, even if the present invention is applied to products using the reed switch, such as a shock sensor and an acceleration sensor employed in a vehicle air bag system, the present invention can obtain the same advantageous effect as described above and provide a stable sensor operation.

When the structure of the present invention is adopted as described above, the present invention makes it possible to stably provide the property of the reed switch without causing variations each time it is fabricated.

The present invention can also provide a reed switch capable of strengthening the strength of sealing of each reed with the glass tube and improving the strength of the reed against torsion or tension applied to the reed from the outside.

Further, the present invention can provide a reed switch capable of changing stiffness of each reed according to required characteristics without changes in the thickness and width of the reed.

Still further, the present invention can provide a stable sensor operation by being applied to a shock sensor or an acceleration sensor.

Still further, the present invention can prevent an increase in the number of manufacturing process steps because no special process steps are added to a process of manufacturing a reed switch.

Since the thickness and width of a reed can be rendered uniform as compared with a method of pressing a wire-like magnetic material so as to form a reed because a plate-like magnetic material is stamped into shape by a die in a reed manufacturing process, the present invention can still further provide the characteristic of a reed switch which is more stable without causing variations in the characteristic thereof for each fabricated reed switch.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. A reed switch comprising:

a glass tube having opposite first and second ends and a cavity defined therein;

a first reed having opposite first and second surfaces and opposite first and second ends, said first reed extending through said first end of said glass tube such that said first end of said first reed is external said glass tube and said second end of said first reed is within said cavity;

a second reed having opposite first and second surfaces and opposite first and second ends, said second reed extending through said second end of said glass tube such that said first end of said second reed is external said glass tube and said second end of said second reed is within said cavity;

wherein said first surfaces at said second ends of said first and second reeds overlap and oppose one another within said cavity, and wherein said first reed includes a first convex region formed in one of said first and second surfaces of said first reed, said first convex region extending across said first end of said glass tube such that a portion of said first convex region is embedded within said glass tube and a remaining portion of said first convex region extends into said cavity.

2. A reed switch as claimed in claim 1, wherein said one of said first and second surfaces of said first reed includes a plurality of protrusions formed therein and located in a vicinity of said remaining portion of said first convex region.

3. A reed switch as claimed in claim 1, wherein one of said first and second surfaces of said first reed includes a plurality of holes formed therein and located in a vicinity of said remaining portion of said first convex region.

4. A reed switch as claimed in claim 1, wherein one of said first and second surfaces of said first reed includes at least one cut-away portion formed therein and located in a vicinity of said remaining portion of said first convex region.

5. A reed switch which is suitable for use in a shock sensor and which comprises:

a glass tube having opposite first and second ends and a cavity defined therein;

a first reed having opposite first and second surfaces and opposite first and second ends, said first reed extending through said first end of said glass tube such that said first end of said first reed is external said glass tube and said second end of said first reed is within said cavity;

a second reed having opposite first and second surfaces and opposite first and second ends, said second reed extending through said second end of said glass tube such that said first end of said second reed is external said glass tube and said second end of said second reed is within said cavity;

wherein said first surfaces at said second ends of said first and second reeds overlap and oppose one another within said cavity, and wherein said first reed includes a first convex region formed in one of said first and second surfaces of said first reed, said first convex region extending across said first end of said glass tube such that a portion of said first convex region is embedded within said glass tube and a remaining portion of said first convex region extends into said cavity.

6. A reed switch as claimed in claim 5, wherein one of said first and second surfaces of said first reed includes a plurality of protrusions formed therein and located in a vicinity of said remaining portion of said first convex region.

7. A reed switch as claimed in claim 5, wherein one of said first and second surfaces of said first reed includes a plurality of holes formed therein and located in a vicinity of said remaining portion of said first convex region.

8. A reed switch as claimed in claim 5, wherein one of said first and second surfaces of said first reed includes at least one cut-away portion formed therein and located in a vicinity of said remaining portion of said first convex region.

9. A reed switch comprising:

a glass tube having opposite first and second ends and a cavity defined therein;

a first reed having opposite first and second surfaces and opposite first and second ends, said first reed extending through said first end of said glass tube such that said first end of said first reed is external said glass tube and said second end of said first reed is within said cavity;

a second reed having opposite first and second surfaces and opposite first and second ends, said second reed extending through said second end of said glass tube such that said first end of said second reed is external said glass tube and said second end of said second reed is within said cavity;

wherein said first surfaces at said second ends of said first and second reeds overlap and oppose one another within said cavity, wherein said first reed includes a first convex region formed in one of said first and second surfaces of said first reed, said first convex region extending across said first end of said glass tube such that a portion of said first convex region is embedded within said glass tube and a remaining portion of said first convex region extends into said cavity, and wherein said second reed includes a second convex region formed in one of said first and second surfaces of said second reed, said second convex region extending across said second end of said glass tube such that a portion of said second convex region is embedded within said glass tube and a remaining portion of said second convex region extends into said cavity.

10. A reed switch as claimed in claim 9, wherein one of said first and second surfaces of said first reed includes a plurality of protrusions formed therein and located in a vicinity of said remaining portion of said first convex region, and wherein one of said first and second surfaces of said second reed includes a plurality of protrusions formed therein and located in a vicinity of said remaining portion of said second convex region.

11. A reed switch as claimed in claim 9, wherein one of said first and second surfaces of said first reed includes a plurality of holes formed therein and located in a vicinity of said remaining portion of said first convex region, and wherein one of said first and second surfaces of said second reed includes a plurality of holes formed therein and located in a vicinity of said remaining portion of said second convex region.

12. A reed switch as claimed in claim 9, wherein one of said first and second surfaces of said first reed includes at least one cut-away portion formed therein and located in a vicinity of said remaining portion of said first convex region, and wherein one of said first and second surfaces of said second reed includes at least one cut-away portion formed therein and located in a vicinity of said remaining portion of said second convex region.

13. A reed switch as claimed in claim 9, wherein said reed switch is suitable for use in a shock sensor.

14. A reed switch as claimed in claim 13, wherein one of said first and second surfaces of said first reed includes a plurality of protrusions formed therein and located in a vicinity of said remaining portion of said first convex region, and wherein one of said first and second surfaces of said second reed includes a plurality of protrusions formed therein and located in a vicinity of said remaining portion of said second convex region.

15. A reed switch as claimed in claim 13, wherein one of said first and second surfaces of said first reed includes a plurality of holes formed therein and located in a vicinity of said remaining portion of said first convex region, and wherein one of said first and second surfaces of said second reed includes a plurality of holes formed therein and located in a vicinity of said remaining portion of said second convex region.

16. A reed switch as claimed in claim 13, wherein one of said first and second surfaces of said first reed includes at least one cut-away portion formed therein and located in a vicinity of said remaining portion of said first convex region, and wherein one of said first and second surfaces of said second reed includes at least one cut-away portion formed therein and located in a vicinity of said remaining portion of said second convex region.

* * * * *